US005621443A

United States Patent [19]

Buschulte et al.

[11] Patent Number: 5,621,443

[45] Date of Patent: Apr. 15, 1997

[54] INK-JET DEVICE AND METHOD OF OPERATION THEREOF

[75] Inventors: Rainer Buschulte, Bad Schönborn; Helmut Kipphan, Schwetzingen, both of Germany

[73] Assignee: Heidelberger Druckmaschinen AG, Heidelberg, Germany

[21] Appl. No.: 311,202

[22] Filed: Sep. 23, 1994

[30] Foreign Application Priority Data

Sep. 23, 1993 [DE] Germany ..... 43 32 264.6

[51] Int. Cl.[6] ..... B41J 2/02

[52] U.S. Cl. ..... 347/73; 347/20; 347/75; 347/82

[58] Field of Search ..... 347/20, 73, 74, 347/75, 76, 77, 82, 83

[56] References Cited

U.S. PATENT DOCUMENTS 3,786,517 1/1974 Krause ..... 347/74

FOREIGN PATENT DOCUMENTS 0223375 3/1992 European Pat. Off. .
2041831 9/1980 United Kingdom ..... 347/82

OTHER PUBLICATIONS

Fan et al; "Drop Shutter for Ink Jet Printing"; IBM Technical Disclosure Bulletin vol. 16, No. 3; Aug. 1973; p. 989.
Erin et al; "Ink Jet Printer Using Skip Jet Phenomenon"; Research Disclosure; No. 20021; Dec. 1980 p. 523.

*Primary Examiner*—John E. Barlow, Jr.
*Attorney, Agent, or Firm*—Herbert L. Lerner; Laurence A. Greenberg

[57] ABSTRACT

Ink-jet device for producing an image on a recording medium includes a droplet-producing device for ejecting droplets along a trajectory, and a droplet-controlling device for controlling the trajectory of the droplets, the droplet-controlling device being formed as a deflection surface, the deflection surface being disposed so that respective droplets impact thereon and rebound to continue the flight thereof, the respective droplets being splittable into at least two subdroplets as a function of selected parameters, and ink-jet process.

28 Claims, 5 Drawing Sheets

1
2
3
4
5
6
7
8
9
10
11
13
15
16
17
18
19
20
21
22
23
24
25
26
30
α

1
2
7
8
9
10
15
16
17
18
19
20
V1
V2
HEATER
LASER

Fig.3
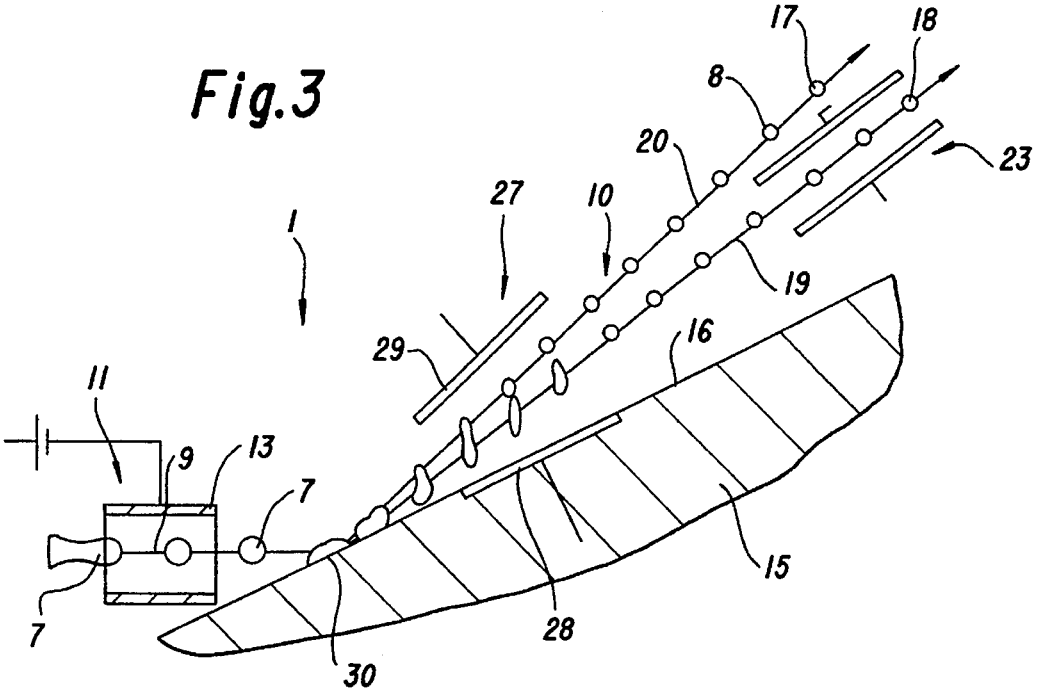
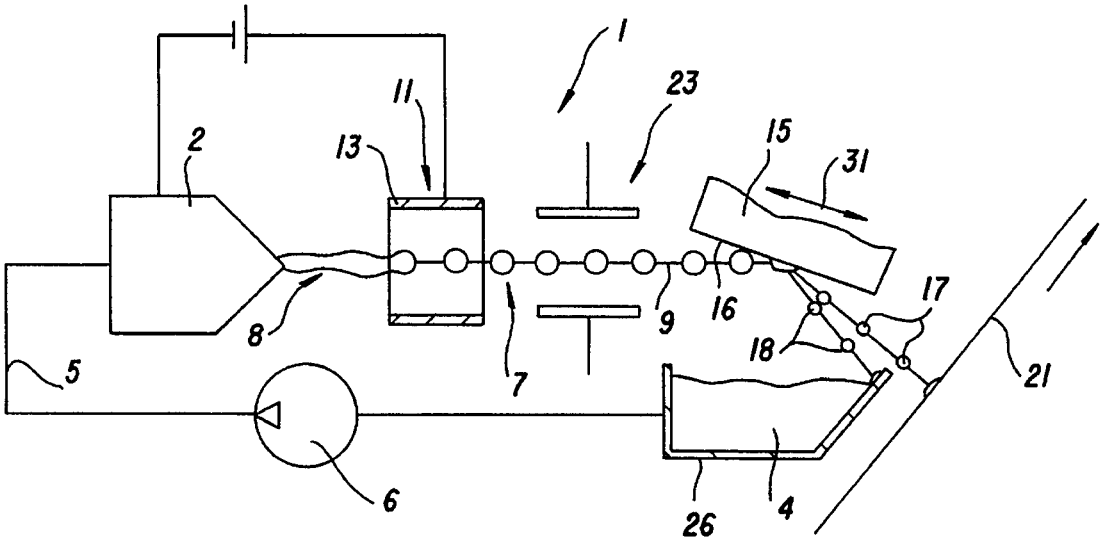
Fig.4

INK-JET DEVICE AND METHOD OF OPERATION THEREOF

BACKGROUND OF THE INVENTION

1. Field of the Invention

The invention relates to an ink-jet device, more particularly, for producing an image on a recording medium, including a droplet-producing device for ejecting droplets along a trajectory, and a droplet-controlling device for controlling the trajectory of the droplets.

2. Description of the Related Art

An ink-jet device of the foregoing general type has become known heretofore from published European patent document 0 223 375 B1. The device described therein includes a droplet-production device for ejecting droplets along a trajectory. On their way to a recording medium, the droplets pass a droplet-controlling device in the form of an electrode arrangement. Situated between the electrode arrangement and the droplet-producing device is a charging device, which applies an electric charge to the droplets as they move along their trajectory. When the electrically charged droplets pass the aforementioned electrode arrangement, it is possible to alter their trajectory due to the application of a corresponding voltage to the electrode arrangement. A result thereof is that the droplets either are caused to impact on the recording medium or, alternatively, are conducted to a droplet-collecting devices and, after having been collected thereat, are returned to a reservoir. The thus recovered ink is then available once again to be resupplied to the droplet-production device. The size of the droplets, i.e., the ink volume thereof, and thus the magnitude of the inking occurring on the recording medium, is dependent upon the construction of the droplet-producing device, which conveys a "chain of droplets", the individual droplets of which, respectively, have a constant volume. It is disadvantageous that, therefore, only a small number of ink shades or color gradations is available and that only a relatively coarse resolution can be achieved.

SUMMARY OF THE INVENTION

It is accordingly an object of the invention, to provide an ink-jet device of the foregoing general type which allows the formation of a great number of gray levels and color shades or gradations, respectively, and permits a fine resolution.

With the foregoing and other objects in view, there is provided, in accordance with the invention, an ink-jet device for producing an image on a recording medium, comprising a droplet-producing device for ejecting droplets along a trajectory, and a droplet-controlling device for controlling the trajectory of the droplets, the droplet-controlling device being formed as a deflection surface, the deflection surface being disposed so that respective droplets impact thereon and rebound to continue the flight thereof, the respective droplets being splittable into at least two subdroplets as a function of selected parameters.

By means of the deflection surface according to the invention, it is thus possible to split preselectively defined droplets of the chain of droplets ejected by the droplet-producing device, with the result that the primary droplets develop into secondary droplets of smaller volume as compared with the primary droplets. Depending upon the respective operating state, chosen on the basis of the selective parameters, it is thus possible to decide whether defined droplets split or do not split when they impact the deflection surface. Furthermore, the parameter control makes it possible to determine into how many subdroplets a primary droplet is to split. Finally, it is also possible, by means of the parameter control, to adjust or set the relative sizes of the individual volumes of the resulting secondary droplets. As mentioned hereinbefore, splitting of the droplets results in streams of secondary droplets, the droplets of which have a selective volume. Hence, it is possible, for example, to produce very fine droplets or, alternatively, droplets with a larger volume. It becomes apparent therefrom that the recording medium is inked in a corresponding manner; that is, if the droplets are small, there is only very little inking, whereas, if the droplets are large, there is strong inking. It is thus possible to produce a desired number of gray levels or gradations of color and, particularly if very small droplets are produced, a high resolution of the image contents is assured. A side effect of the impacting of the primary droplets on the deflection surface is that their trajectory is affected; that is, the direction of the trajectory of a droplet changes as a result of impact on the deflection surface. There results either just one new trajectory, namely the secondary trajectory, along which droplets, namely secondary droplets, move insofar as there has been no splitting. If, however, the impact on the deflection surface leads to the splitting of the droplet, then there result at least two secondary trajectories, which extend in different directions; that is, they diverge. It is possible to use both chains of droplets to produce the image on the recording medium or to "block out" at least one of the chains of secondary droplets. Blocking-out is effected by collecting; that is, the corresponding secondary droplets are supplied preferably to a collecting vessel and are recycled to the droplet-producing device. Throughout the instant application, the word "ink" (also in conjunction with the term "ink-jet device") signifies that use is made of an inking medium, of whatever kind, in order to produce a marking on the recording medium. There is, therefore, no restriction to the word "ink".

In accordance with another feature of the invention, the droplets impact at a given region of the deflection surface, and a heating device is provided for heating the droplet-impact region of the deflection surface. The heating apparatus makes it possible for the deflection surface, or at least that region of the deflection surface on which the primary droplets impact, to be brought to a desired temperature. It is preferable to adjust thereat the so-called fluid-specific Leidenfrost temperature (approx. 100° C. above the evaporation temperature of the liquid/ink used), with the result that the primary droplets strike a "hot wall" from which they reversingly rebound, forming a vapor cushion. The adhesion of liquid to the deflection surface is completely prevented in this manner. The impacting droplets undergo elastic reflection as they strike the deflection surface, which is inclined in relation to the direction of flight of the primary droplets. It is possible, as a function of the aforementioned parameters, that is, in the instant example, the temperature and the angle of inclination of the deflection surface, to adjust or set whether, after striking the deflection surface, the primary droplets "burst" into subdroplets or whether the droplet is merely diverted while the volume thereof remains unchanged. To be cited in this connection as further parameters, which can be used individually or in any combination, are also the velocity of the droplet in relation to the deflection surface; the influencing of the droplets by means of an electric field; the surface characteristics and material of the deflection surface; and also the temperature of the droplet liquid itself. The various possibilities of control, through the choice and specification of the magnitude of the parameters, will be discussed in greater detail hereinbelow.

In accordance with a further feature of the invention, the ink-jet device includes a droplet-heating device. The droplet-heating device imparts a desired temperature to the primary droplets; that is, the droplet liquid is heated to a desired temperature, this making it possible to influence the conditions on impact with the deflection surface. It is thus possible to select whether droplet splitting results in two subdroplets with approximately equal volumes or with different volumes. The sizes of the individual volumes can be specified in a desired manner by the aforementioned measure.

In accordance with an added feature of the invention, the droplet-heating device is cooperatively associated with the droplet-producing device so that the droplets ejected by the droplet-producing device are at a selective temperature.

In accordance with an additional feature of the invention, the droplet-heating device is disposed so as to be able to act upon the droplets while they are in flight.

In accordance with yet another feature of the invention, the droplet-heating device is formed as a laser for heating the droplets in flight.

Thus, additionally or alternatively, it is also possible for the droplet-heating device to act on droplets in flight, in particular in that the droplet-heating device is in the form of a laser, the laser beam of which heats the droplets in flight.

In accordance with yet a further feature of the invention, the deflection surface is coated with a liquid-repellent.

In accordance yet an added feature of the invention, the liquid repellent is formed of silicone or polytetrafluoroethylene, known by the trade name Teflon.

Thus, the deflection surface is provided with a liquid-repellent coating, particularly of silicone or Teflon. The coating has the surprising effect that the desired splitting of droplets takes place even if the surface temperature of the deflection surface or the temperature of the droplets has not been raised to a higher value. Rather, it may be sufficient to effect no increase in temperature whatsoever on the deflection plate and/or the droplets or to provide for just a small increase in temperature in the deflection surface and/or the droplet liquid. Nevertheless, the effect of elastic reflection is maintained, with the droplets being split, if desired. This feature, therefore, is particularly energy-saving.

In accordance with yet an additional feature of the invention, the deflection surface has a given defined roughness. In order to be able to effect the splitting of droplets in a desired manner, to determine the number of resulting chains of secondary droplets or, alternatively, to prevent the splitting of droplets, this feature is provided. The roughness is, therefore, also one of the aforementioned parameters.

In accordance with another feature of the invention, the deflection surface has a defined texturing. The type of texturing and also the geometry thereof has an effect upon the conditions when impact of the primary droplets occurs and permits the desired setting or adjustment, that is, splitting of the droplets or no splitting.

In accordance with a further feature of the invention, the ink-jet device includes means for selectively adjusting the relative velocity between the impacting droplets and the deflection surface. Thus, the relative velocity between the impacting droplets (primary droplets) and the deflection surface is selectively settable or adjustable. If there is a high relative velocity, a correspondingly high amount of energy is converted on impact, the energy having an effect upon splitting. If, due to a lower relative velocity, the energy is smaller, there is no splitting. A large amount of energy leads also to more than two subdroplets and, finally, it is also possible through the intermediary of the energy to determine the sizes of the volumes of the subdroplets.

In accordance with an added feature of the invention, the flying velocity of the droplets is selectively adjustable by means of the droplet-producing device.

In accordance with an additional feature of the invention, the ink-jet device includes a droplet-braking and/or accelerating device, the flying velocity of the droplets being selectively adjustable by means of one of the droplet-producing device and the droplet-braking and/or accelerating device.

The droplet-producing device preferably comprises a piezoelectric-crystal arrangement which, through suitable energization, undergoes changes in volume, as a result of which the droplets are ejected from a nozzle. Depending upon volume, travel and also rate of change, and so forth, it is thus possible to vary the flying velocity of the droplets. The aforementioned droplet-braking/accelerating device may, for example, be in the form of a device acting on the droplets in contact-free manner, the latter device emitting an airstream which brakes or accelerates the droplets. Furthermore, it is also possible to charge the droplets electrically and then to expose them to an accelerating field or to decelerate them by means of an electric field.

In accordance with still another feature of the invention, the deflection surface is movable by means of a driving device and oscillates, respectively, in or opposite to the direction of the trajectory so as to adjust the relative velocity.

In accordance with still a further feature of the invention, the deflection surface is movable by means of a driving device and oscillates, respectively, as a function of the droplet-ejection frequency of the droplet-producing device. In particular, the flying velocity of the droplets is selectively settable or adjustable by means of the droplet-producing device and/or by means of a droplet-braking and/or accelerating device. Thus, according to a further development of the invention, with the relative velocity set, the deflection surface is movable by means of a driving device in or opposite to the direction of the trajectory. Additionally or alternatively, it is also possible for the deflection surface to be in the form of an oscillatory system; that is, it is set in a state of oscillation by means of suitable devices, with the direction of the oscillating motion being selected in such a manner that at least one component thereof accords with the direction of the trajectory of the primary droplets, with the result that the oscillating motion, or a component thereof, is directed either opposite to the direction of flight of the primary droplets or, after a reversal of the oscillation, in the direction of the trajectory of the primary droplets. In this manner, the relative velocity between droplet and deflection surface is in one case greater and in the other case, after reversal of the oscillation, smaller. Depending upon the currently pertaining operating state when a droplet impacts the deflection surface, there will thus be a corresponding conversion of energy, with the result that either the droplet splits (into two or more subdroplets of equal or unequal volume) or the droplet does not split.

In accordance with still an added feature of the invention, the driving device is a deflection-surface swiveling device.

The movement of the deflection surface may be accomplished with the deflection surface itself being rigid and being moved in its entirety by means of the driving device, which may be effected in particular by means of a vibration device, or with the deflection surface forming the aforementioned oscillatory system; that is, the deflection surface is excited by means of the driving device and is in an oscillating state, comparable to that of an eardrum when excited. Such an oscillating deflection surface exhibits locally different amplitudes. The amplitude in the peripheral regions of the deflection surface is smaller than in the center. The fact that the point of impact of the primary droplets is selective, through suitable deflection of the trajectory of the primary droplets, means that the velocity of the impacting droplets in relation to the deflection surface is selective.

In accordance with still a further feature of the invention, the driving device is a deflection-surface vibration device. Small, preferably periodic swiveling motions of the deflection surface result in motions in or opposite to the direction of the primary trajectory. In particular, the geometry is such that at least one component of the swiveling motion lies in or opposite to the direction of the primary trajectory. The farther the swiveling axis of the deflection surface is removed from the point of impact of the primary droplets, the greater is the distance moved and the deflection-surface velocity. Through synchronization of the droplet-ejection rate with the swiveling motion, it is possible, at the time of impact of the primary droplets, for the deflection plate to be moving in or opposite to the trajectory of the primary droplets, with the result that it is possible to set suitably higher or lower relative velocities and impact angles between the incoming droplet and the deflection surface.

Preferably, the droplets ejected by the droplet-producing device are primary droplets on the primary trajectory, and the droplets rebounding from the deflection surface are secondary droplets on at least one secondary trajectory. If the droplet is split into two parts, there are two secondary trajectories, which diverge from one another. If the droplet is split into more than two parts, there will be a corresponding number of secondary trajectories.

In accordance with still an additional feature of the invention, the trajectory is formed of a primary trajectory and at least one secondary trajectory, the droplets ejected by the droplet-producing device are primary droplets on the primary trajectory, and the droplets rebounding from the deflection surface are secondary droplets on the at least one secondary trajectory, and including a droplet-splitting electrode arrangement for applying an electric field to the secondary droplets disposed in the vicinity of the secondary trajectory, and a charging device for electrically charging the primary droplets.

In accordance with another feature of the invention, the droplet-splitting electrode arrangement is disposed near the reflection surface. Thus, there may be disposed in the region of the secondary trajectory, in particular near the deflection plate, a droplet-splitting electrode arrangement for applying an electric field to the secondary droplets. It is important, in this regard, that the primary droplets be electrically charged by means of a charging device. The charging device is situated preferably in the region between the droplet-producing device and the deflection surface. In accordance with a further feature of the invention, the charging device is a charging ring electrode situated in the primary trajectory. It is in particular in the form of a ring electrode in which the primary droplets are formed by constriction of the liquid jet. The charging of the electrode produces a charge in the developing droplet, with the current produced being drained through the liquid and the grounded ink reservoir. The electric potential is not lost through the impact of the primary droplet on the deflection surface. The parameters of the overall arrangement are set so that the droplet is not split by its impact with the deflection surface. It is, however, in a marginal state of "almost splitting"; that is, for example, its geometrical shape is no longer that of a droplet, but rather that of a "figure eight". By means of the aforementioned droplet-splitting electrode arrangement, it is possible to influence the respective secondary droplet just after impact in such a manner that it splits or does not split. This is accomplished by the selection of suitable potential at the electrodes of the droplet-splitting electrode arrangement. The arrangement is formed of two spaced-apart oppositely positioned electrodes, the secondary droplets flying through the thus formed gap. Preferably, one of the electrodes is integrated into the deflection surface and the other electrode is positioned opposite the deflection surface at a suitable distance from and, if required, at an angle to the other electrode. Splitting or non-splitting can be controlled depending upon the magnitude of the field strength of the droplet-splitting electrode arrangement and/or the polarity and/or the fact whether an electric field has been built up at all. If there is splitting, this is once again to the aforementioned extent, namely the number of secondary droplets and the specification of predeterminable volumes of the secondary droplets.

In accordance with an added feature of the invention, the ink-jet device includes a deflecting electrode arrangement situated in the primary trajectory and disposed between the charging device and the deflection surface. The charging device will have imparted an electric charge to the primary droplets as they move on the primary trajectory. As the droplets, on their further flight, then pass the deflecting electrode arrangement, if the deflecting electrode arrangement exhibits a defined electric field, then the primary droplets are influenced in their trajectory, thus correspondingly determining the point of impact on the deflection surface. Preferably, and this applies to all embodiments of the invention, the deflection surface extends at an acute angle with respect to the direction of the primary trajectory. Consequently, moving the point of impact of the primary droplets results in a change in the angles on impact (entry angle=exit angle), thus making it possible to exert an influence on the size of the droplets as they split, that is, on the size of the subdroplets.

In accordance with an additional feature of the invention, the ink-jet device includes a collecting element for respective secondary droplets, the collecting element being associated with the at least one secondary trajectory.

In particular, there is a split into, for example, two subdroplet streams, with one subdroplet stream being directed so that the subdroplets thereof enter a collecting reservoir, in which case those subdroplets are then not available for producing the image, but are recycled into the system. The remaining subdroplet stream flies past the collecting reservoir and reaches the recording medium. As mentioned hereinbefore, the volumes of the droplets of the stream can be set by means of the deflecting electrode arrangement; that is, depending upon the control of the deflecting electrode arrangement, the size of the droplets which reach the recording medium is preselective and results in corresponding inking of the recording medium. Alternatively or additionally, the aforementioned angular conditions may also be brought about in that the angle and/or position of the deflection surface is altered; that is, the setting of the volumes of the subdroplets is variable through this measure. Consequently, it is always possible to influence the direction of the secondary trajectories, with the result that the associated droplets either enter a collecting reservoir or, if desired, strike the recording medium.

In accordance with yet another feature of the invention, the ink-jet device includes a plurality of the deflection surfaces disposed so that a droplet formed by the droplet-producing device passes the plurality of deflection surfaces in succession. Thus, it is also possible for one or more deflecting electrode arrangements not to be disposed in the region of the primary trajectory, but in the region of the secondary trajectory/trajectories. According to a further feature, a droplet ejected by the droplet-producing device is fed consecutively to a plurality of deflection surfaces. As mentioned hereinbefore, there not only ensues a change in the trajectory, but this measure also makes it possible to split a primary droplet and then, in turn, to split the resulting secondary droplets when they impact on a following deflection surface, and so forth, it being possible ultimately in this manner to obtain very fine droplets. Secondary droplets which, in the course of the multiple splitting, are not to be used for the recording medium are always directed on trajectories which terminate in collecting reservoirs.

In accordance with yet a further feature of the invention, the ink-jet device includes a plurality of droplet-producing devices, and means for feeding droplets produced thereby, grouped and in focus, to the recording medium. Finally, it is advantageous if the droplets from a plurality of droplet-producing devices, grouped and focused, are fed to the recording medium. In this construction, it is possible for very large volumes of ink to be fed to the recording medium. In this connection, some droplet trajectories or at least one of the droplet trajectories may be provided with a deflection surface, with the result that, also when droplets are merged or fed to the same point on the recording medium, there is droplet splitting, at least in one of the droplet substreams. It is possible in this manner to set with great accuracy the desired total volume of the ink supplied and thus the production of gray levels.

In accordance with another aspect of the invention, there is provided an ink-jet process for producing an image on a recording medium, which comprises ejecting droplets along a trajectory, controlling the trajectory of the droplets with a droplet-controlling device formed as a deflection surface and disposed so that respective droplets impact thereon and rebound to continue the flight thereof, the respective droplets being splittable into at least two subdroplets as a function of selected parameters, and selecting parameters so that the respective droplets are split into at least two subdroplets.

In accordance with another mode of the process according to the invention, the parameters are selected from the group consisting of the surface characteristics of the deflection surface, the material of the deflection surface, the temperature of the deflection surface, the temperature of the droplets, the relative velocity between droplet and deflection surface and the angle of impact of the droplets on the deflection surface.

In accordance with a further mode of the invention, the ink-jet process includes splitting the subdroplets at least another time by colliding the subdroplets with a further deflection surface. It is thereby possible to obtain very small droplet volumes.

In accordance with a concomitant mode of the invention, the ink-jet process includes forming a plurality of droplet streams having, in at least one stream thereof, droplets which have been split, and feeding streams of respective droplets and/or subdroplets, in grouped fashion, to the recording medium. It is thereby possible to produce an image dot with a particularly fine gradation of gray.

Other features which are considered as characteristic for the invention are set forth in the appended claims.

Although the invention is illustrated and described herein as embodied in an ink-jet device and a method of operation thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which: drawings, in which:

BRIEF DESCRIPTION OF THE DRAWING

FIG. 3 is a fragmentary view of a third embodiment of the ink-jet device;

FIG. 4 is a slightly enlarged view of FIG. 1 showing a fourth embodiment of the ink-jet device;

DESCRIPTION OF THE PREFERRED EMBODIMENTS

Figure 1:
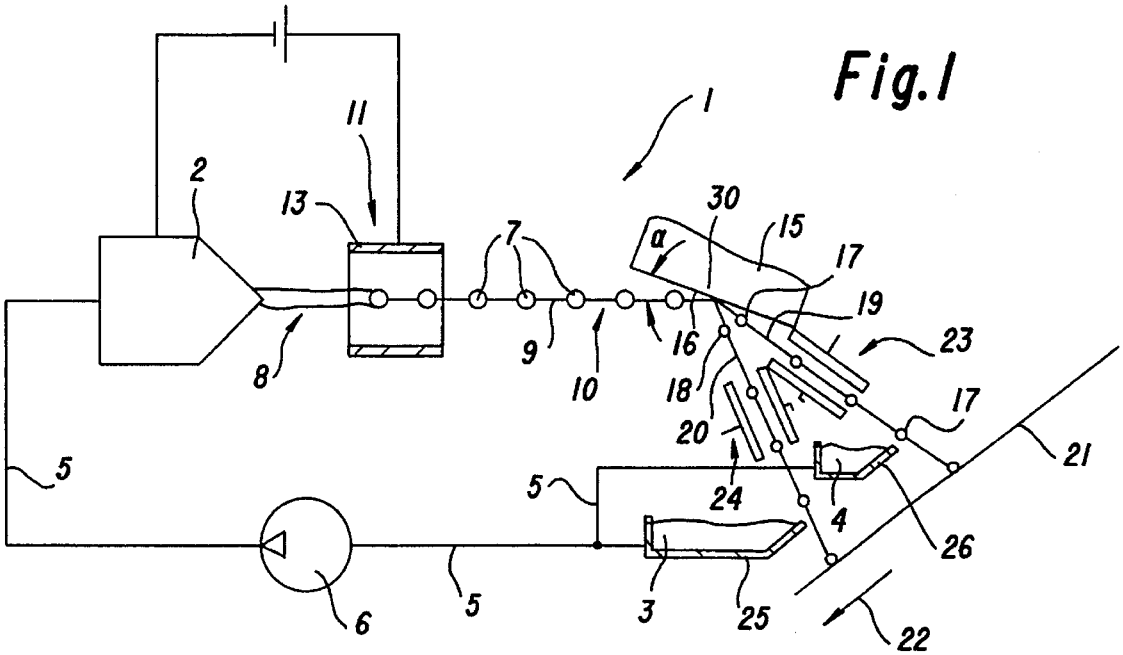
FIG. 1 is a diagrammatic and schematic view of a first embodiment of an ink-jet device constructed in accordance with the invention.

Referring now to the drawings and, first, particularly to FIG. 1 thereof, there is shown therein an ink-jet device 1, including a droplet-producing device 2 which is supplied with ink from ink reservoirs 3 and 4 via lines 5 by means of a pump 6. The droplet-producing device 2 has a nozzle from which a liquid jet 8 of the ink is ejected. Individual primary droplets 7 are formed from the liquid jet 8 in a ring electrode 13 of a charging device 11, and move along a trajectory 10 forming a primary trajectory 9.

Situated at the end of the primary trajectory 9 is a deflection element 15, which has a deflection surface 16. The deflection surface 16 is flat in form and extends at an acute angle alpha with respect to the direction of the primary trajectory 9.

During the flight of the droplets 7 on the primary trajectory 9, they strike the inclined deflection surface 16 from which they rebound and continue their flight. As a result of the impact, each primary droplet 7 is split into two secondary droplets 17 and 18. The individual secondary droplets 17 and 18 form corresponding secondary chains of droplets. The secondary droplets 17 and 18 move on secondary trajectories 19 and 20. At the ends of the secondary trajectories 19 and 20, the respective secondary droplets 17 and 18 strike a recording medium 21, such as, paper, for example, which moves in the direction of the arrow 22. The secondary droplets 17 and 18 produce an image on the recording medium 21.

Each secondary trajectory 19 and 20, respectively, is associated with a deflecting electrode arrangement 23 and 24, respectively. Each deflecting electrode arrangement 23 has two plate electrodes, between which the respective secondary trajectory 19 or 20 extends. The ink reservoir 23, formed as a collecting reservoir 25, is situated to the side of the secondary trajectory 20 and the ink reservoir 4, which is similarly formed as a collecting reservoir 26, is situated to the side of the secondary trajectory 19.

Preferably, the deflection surface 16 is heated by means of a non-illustrated heating device. A consequence thereof is that primary droplets 7 impacting thereon are elastically reflected on a vapor cushion. Simultaneously, the aforementioned splitting of the droplets occurs.

The primary droplets 7 passing the charging device 11 are electrically charged due to the existence of an electric field therein; that is, they possess an electric charge, which they retain, even after droplet splitting. As the thus charged secondary droplets 17 and 18, respectively, formed from the primary droplets 7, then pass the respective deflecting electrode arrangements 23 and 24, and if the deflecting electrode arrangements 23 and 24 generate defined electric fields, a deflection results, i.e., the relevant secondary droplets 17 and 18 are deflected into the ink reservoirs 4 and 3, respectively. Due to the fact that the relatively large-sized primary droplets 7 are broken down into secondary droplets 17 and 18, respectively, the relative volumes of the secondary droplets 17 and 18 being capable of being selected by means of suitable parameters, such as the impact velocity on the deflection surface 16, it is possible to apply a desired size of droplet to the recording medium which, depending upon the size of droplet selected, results in a corresponding gray level with correspondingly desired resolution.

Figure 2:
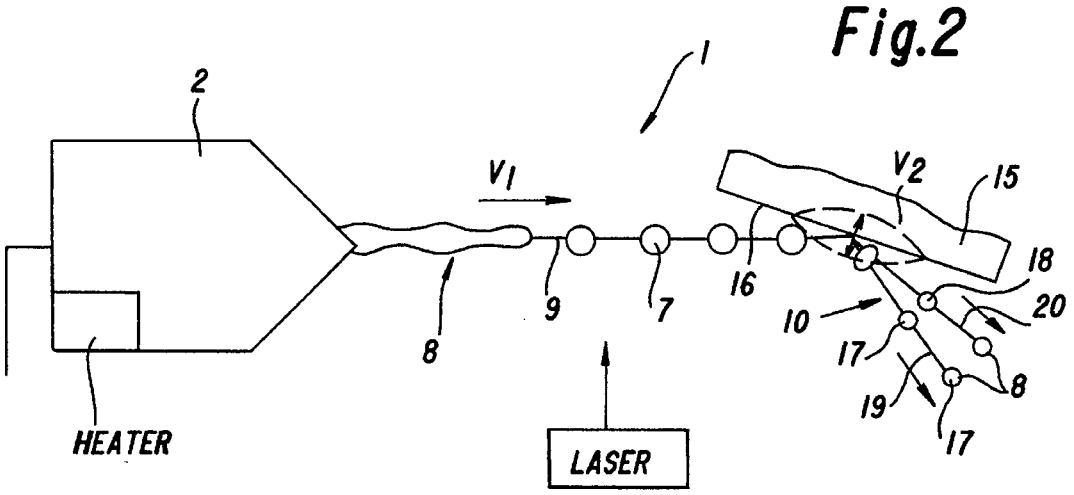
FIG. 2 is an enlarged fragmentary view of FIG. 1 showing a second embodiment of the ink-jet device according to the invention.

FIG. 2 shows a detail of another embodiment of the ink-jet device 1 according to the invention. From the droplet-producing device 2, the primary droplets 7 reach the deflection surface 16, which oscillates. The oscillations are produced by means of a suitable non-illustrated driving device. The oscillating movement is indicated by the somewhat elliptical form shown in broken lines and the double-headed arrow associated therewith. The somewhat elliptical form shows that the deflection or oscillation amplitude in the center of the deflection surface 16 is greater than at the edges. Consequently, a corresponding velocity profile is also provided. The velocity of the primary droplets 7 is identified as $V_1$; the velocity of the oscillating deflection surface 16 is identified as $V_2$. When the velocity $V_2$ is broken down into its components, one of the components extending in or opposite to the direction of the primary trajectory 9, then it becomes apparent that, depending upon the instant of impact of a primary droplet 7 on the oscillating deflection surface 16, there is either a lower relative velocity or a higher relative velocity on impact. The relative velocity or impact velocity is particularly great when the deflection surface 16 oscillates towards the incoming primary droplets 7. If the deflection surface 16 should just happens to be oscillating in the direction of the primary trajectory, then there is a lower relative velocity. Depending upon the respective adjustable relative velocity, which requires the oscillations of the deflecting surface 16 to be synchronized with the droplet-ejection frequency, it is possible to obtain a reflection at the deflection surface 16 with which either a droplet splitting occurs or no droplet splitting occurs.

FIG. 3 illustrates a detail of another embodiment of the ink-jet device according to the invention. Just as with regard to FIG. 2, so too with regard to the embodiment shown in FIG. 3, reference is made to component parts which have been omitted from the last-mentioned figure, but are clearly visible in FIG. 1, and indeed constitute component parts of all of the embodiments. It is apparent from FIG. 3 that a charging device 11 is disposed in the region of the primary trajectory 9 and has a ring electrode 13. The embodiment of FIG. 3 has as a special feature that a droplet-splitting electrode arrangement 27 is disposed in the starting or initial region of the secondary trajectories 19 and 20. The droplet-splitting electrode arrangement 27 includes two spaced-apart, oppositely positioned plate electrodes 28 and 29, which are connected to a corresponding control voltage output of a non-illustrated control system. The plate electrode 28 is integrated into the deflection surface 16; the surface of the plate electrode 20 is disposed in alignment with the remaining surface portion of the deflection surface 16. The further plate electrode 29, disposed opposite and at a spaced distance from the plate electrode 28, extends in a manner that the electrode plane thereof is preferably at an angle with respect to the plane of the plate electrode 28, and being inclined thereto so that, as viewed in the direction of the secondary trajectories 19 and 20, a diverging arrangement is formed. The two secondary trajectories 19 and 20 extend between the two plate electrodes 28 and 29. Further provided in the course of the secondary trajectory 19 is a deflecting electrode arrangement 23, which is formed of two plate electrodes, between which the secondary trajectory 19 extends.

During the operation of the ink-jet device shown in FIG. 3, the oncoming primary droplets 7 are charged by means of the charging device 11. Thereafter, in the impact region 30, the droplets 7 are caused to impact with the deflection surface 16, which extends obliquely with respect to the primary trajectory 9. The deflection surface 16 may, for example, be heated, or may be formed of a liquid-repellent material, such as Teflon, for example. It is necessary to ensure that there is no wetting of the deflection surface 16, but that the primary droplets 7 be elastically reflected. As viewed in the direction of the secondary trajectories 19 and 20, the impact region 30 is followed by the plate electrode 28 in the region of the deflection surface 16. Consequently, the droplet-splitting electrode arrangement is located downstream of the impact region 30. Accordingly, the droplet-splitting electrode arrangement acts upon droplets that have already been reflected from the deflection surface 16. The arrangement is such that, through the setting of defined parameters, the reflected droplets do not split. If those parameters are altered, however, which can be effected by exposing the reflected droplets to an electric field from the droplet-splitting electrode arrangement, then the droplets may be split, for example into two subdroplets. This means that, through appropriate control of the droplet-splitting electrode arrangement, it is possible to cause droplet splitting to occur or not to occur, selectively. Consequently, in the case of non-splitting, large droplet volumes can be fed to the recording medium or, alternatively, depending upon the parameters, a droplet splitting takes place, with the individual volumes of the subdroplets also being controllable by means of the parameters. It is thus possible accurately to select the desired droplet volume for both streams of subdroplets. By means of the deflecting electrode arrangement 23, it is possible for the subdroplet stream on the secondary trajectory 19 to be influenced in such a manner that it either reaches the recording medium or, alternatively, enters an ink reservoir (not shown in FIG. 3).

FIG. 4 shows a further embodiment of the ink-jet device 1, which differs essentially from the embodiment in FIG. 1 in that a deflecting electrode arrangement 23 is disposed between the charging device 11 and the deflection surface 16. The primary droplets 7 fed from the droplet-producing device 2 are created in the charging ring electrode 13, where they are provided with a corresponding electric potential. They then fly through the deflecting electrode arrangement 23, by means of which they can be controlled in such a manner that different points of impact are obtained on the deflection surface 16. This, in turn, has an effect upon the impact angle and also upon the velocity at which impact takes place on the deflection surface 16. This potential for effecting variations makes it possible to exert an influence upon the individual volumes of the subdroplets forming due to the impact thereof on the deflection surface 16. It is apparent from FIG. 4 that the secondary droplets 17 are fed to the recording medium 21, while the secondary droplets 18 land in an ink reservoir 4. Because the volume of the secondary droplets 17 can be set by means of the deflecting electrode arrangement 23, it is possible to adjust the required gray level, in a desired manner.

Alternatively, in FIG. 4, a double-headed arrow 311 is shown in the region of the impact surface 16. The double-headed arrow 311 is intended to indicate that it is possible to alter the position of the deflection element 15. A suitable non-illustrated device is provided for this purpose. Through such change in position, also, it is possible to exert an influence upon the volumes of the subdroplets. This measure may be implemented alone or in combination with the aforementioned deflecting electrode arrangement 23.

Figure 5:
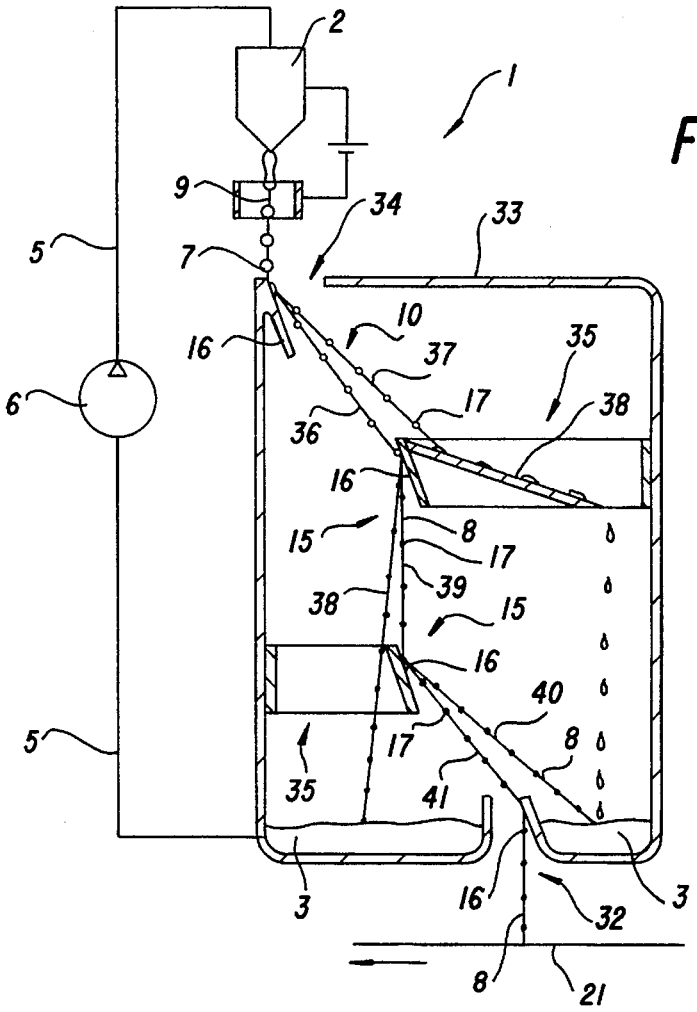
FIG. 5 is a diagrammatic and schematic view of a fifth embodiment of the ink-jet device wherein multiple splitting of the ink stream is performed.

FIG. 5 shows an embodiment of the ink-jet device wherein multiple droplet splitting occurs. Several deflection surfaces 16 are provided. The deflection surfaces 16 are situated inside a housing 31 which is formed with a bottom opening 32. An inlet opening 34 is formed at the top 33 of the housing 31. The bottom region of the housing 31, situated to either side of the bottom opening 32, is trough-like in form and serves as an ink reservoir 3. The deflection surfaces 16 are formed on brackets 35, which are attached to side walls of the housing 31.

The ink reservoir 3 communicates with a pump 6 and a droplet-producing device 2. The primary droplets 7 supplied from the droplet-producing device 2 fly through the inlet opening 34, where they strike a deflection surface 16', as a result of which they split into two subdroplet streams 36 and 37. The subdroplet stream 37 lands on an inclined drain surface 380 on the bracket 35, from which it drips into the ink reservoir 3. The associated subdroplets, therefore, are not fed to the recording medium 21. Conversely, the subdroplet stream 36 strikes a further deflection surface 16" on the end face of the bracket 35 and is, in turn, split into two subdroplet streams 38 and 39. The subdroplet stream 38 passes through an opening formed in the bracket 35 and enters the ink reservoir 3. The subdroplet stream 39 strikes the deflection surface 16 formed on the end face of the lower-lying bracket 35, and is, in turn, split thereat into two subdroplet streams 40 and 41. The droplets of the subdroplet stream 40 enter the ink reservoir 3. The droplets of the subdroplet stream 41 fly through the bottom opening 32, being deflected once again on a deflection surface 16'''; in this case, however, there is no droplet splitting. It is conceivable, however, in this case, also, as yet another embodiment, to perform a droplet splitting. This is the case when it is desired that two droplet streams should strike the recording medium 21.

It becomes apparent from the foregoing description that the relatively large-sized primary droplets 7 are converted, through multiple droplet splitting, into very fine droplets, which then reach the recording medium. It is possible, therefore, to achieve a very fine resolution due to the fine ink droplets. Conversely, however, it is also possible, by means of the device according to the invention, to make the primary droplets comparatively large in size, which offers no problem from the point of view of the process, without having to forego the fine resolution on the recording medium 21.

Figure 6:
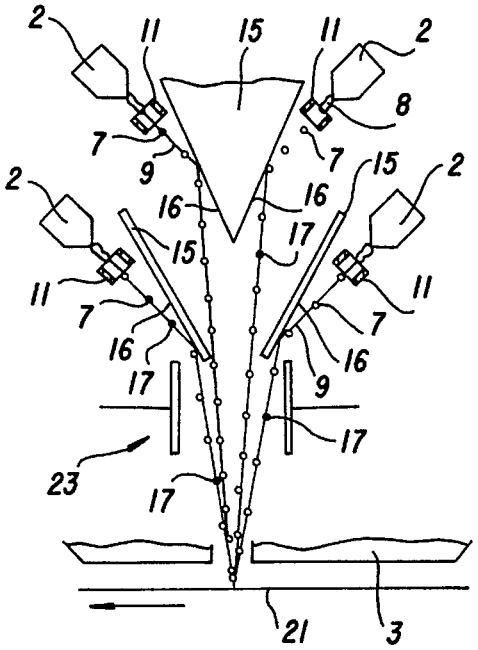
FIG. 6 is a diagrammatic view of a seventh embodiment of the ink-jet device wherein a plurality of ink streams are grouped.

In the embodiment shown in FIG. 6, the objective is to produce the largest possible number of gray levels for each image dot on the recording medium 21. Provided for this purpose is a plurality of droplet-producing devices 2, which feed the primary droplets 7 thereof to deflection surfaces 16, which are disposed in such a manner that the reflected droplets enter trajectories which converge with respect to one another, as a result of which the droplets reach the recording medium 21 in focused form. Provision can be made for droplet splitting to occur at least upon the collision of the primary droplets from one of the droplet-producing devices 2, due to which it is possible in general to exert an influence upon the overall volume of ink and thus upon the gray-level value of the image dot.

Further derived from FIG. 6 is that, disposed between the furthest-downstream deflection surface 16/deflection surfaces 16, respectively, is a deflecting electrode arrangement 23 by means of which the secondary-droplet streams, or at least some of the secondary-droplet streams, can be controlled in such a manner that the associated droplets enter an ink reservoir 3 and do not reach the recording medium 21. Likewise provided in the embodiment shown in FIG. 6 are charging devices 11, which impart a charge to the primary droplets 7 formed from the liquid jet; that is, the primary droplets 7 are electrically charged, with the result that they can be controlled in their trajectory by means of the deflecting electrode arrangement 23.

Figure 7:
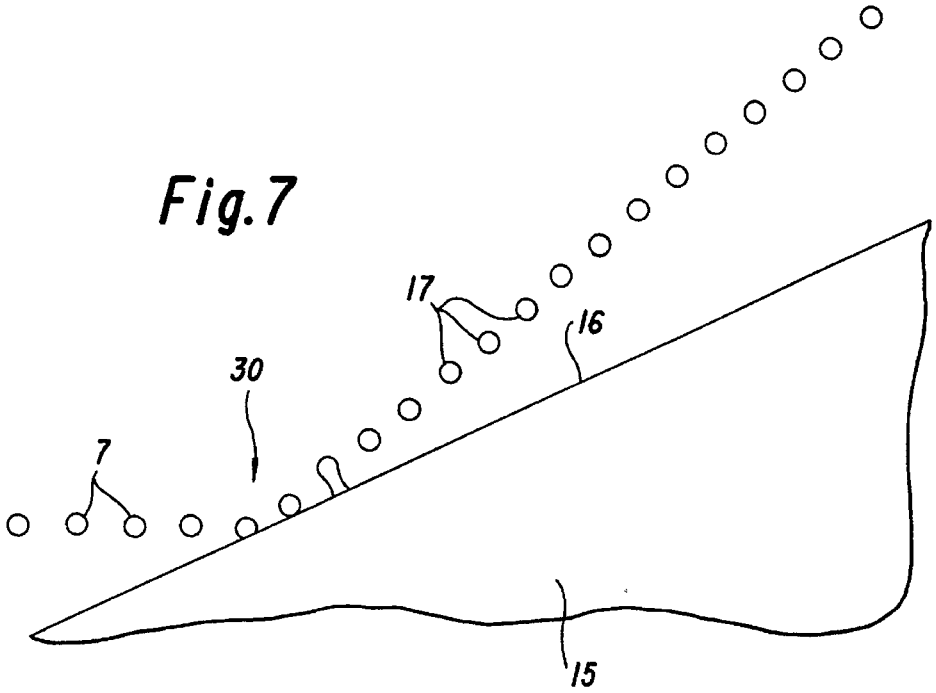
FIG. 7 is an enlarged representation of a collision of a chain of droplets with a deflection surface.
Figure 8:
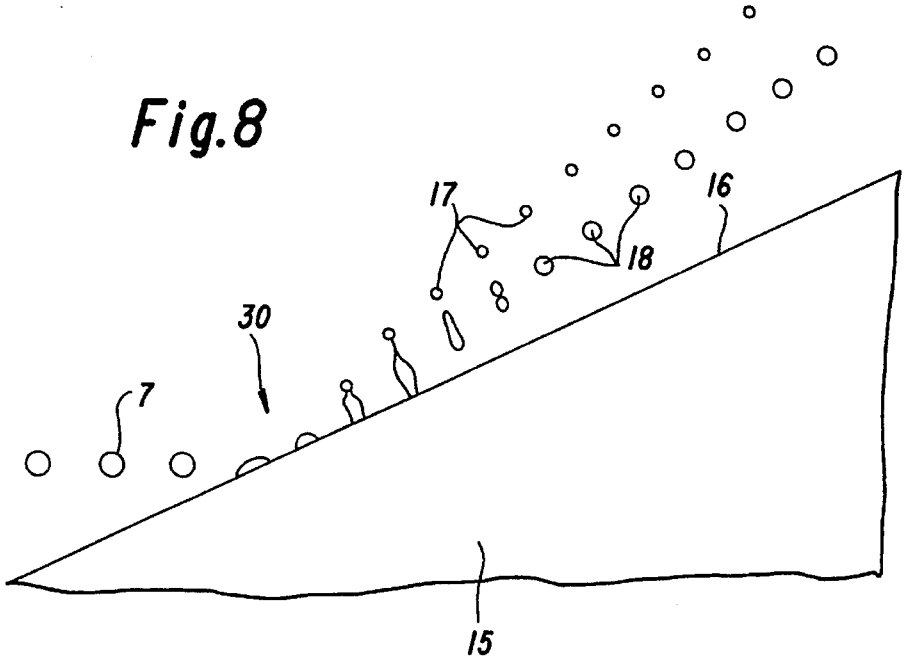
FIG. 8 is another view of FIG. 7, however, showing the impacting droplets being split.

FIG. 7 illustrates the elastic impact of the primary droplets on the deflection surface 16. Arriving from the left-hand side of the figure, the primary droplets 7 strike the deflection surface 16, thereby undergoing deformation, and are then reflected and rebound from the deflection surface 16 without any droplet splitting. Conversely, in FIG. 8, the aforementioned parameters are set differently, with the result that, after the primary droplets 7 have impacted the deflection surface 16, they are split into two substreams. It is clearly discernible that the volumes of the individual secondary-droplet streams are of different magnitudes.

Figure 9:
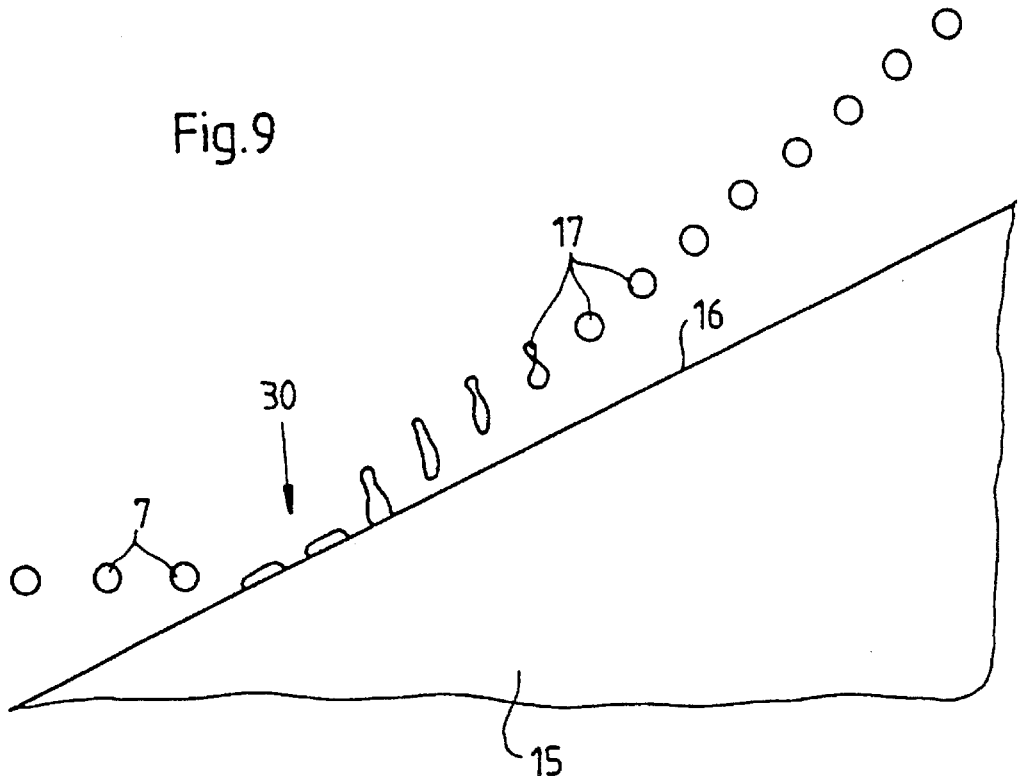
FIG. 9 is yet another view of FIG. 7, however, wherein no splitting of the droplets has yet occurred.

FIG. 9 represents a collision process wherein the droplets just fail to split. The primary droplets impacting the deflection surface 16, undergo extreme deformation into approximately figure eight-shaped forms which, after collision, contract again and, during further flight thereof, regain their droplet shape. Under such a condition, if one were, for example, to increase the velocity of the primary droplets just slightly or expose the secondary droplets to an electric field in the region of the collision zone, then droplet splitting would occur. Electrical control over the droplets requires that the primary droplets 7 should be electrically charged, which is possible to effect by means of a charging electrode arrangement.

We claim:

1. Ink-jet device for producing an image on a recording medium, comprising a droplet-producing device for ejecting droplets along a trajectory, and a droplet-controlling device for controlling the trajectory of the droplets, said droplet-controlling device being formed as a deflection surface, said deflection surface being disposed so that respective droplets impacting thereon are split into at least two subdroplets.

2. Ink-jet device according to claim 1, wherein the droplets impact at a droplet-impact given region of said deflection surface, and including a heating device for heating said droplet-impact region of said deflection surface.

3. Ink-jet device according to claim 1, wherein said droplet-producing device includes a droplet-heating device.

4. Ink-jet device according to claim 3, wherein the droplets ejected by said droplet-producing device are heated to a selective temperature by said droplet-heating device.

5. Ink-jet device according to claim 3, wherein said droplet-heating device is disposed so as to be able to act upon the droplets while they are in flight.

6. Ink-jet device according to claim 5, wherein said droplet-heating device is formed as a laser for heating the droplets in flight.

7. Ink-jet device according to claim 1, wherein said deflection surface is coated with a liquid repellent.

8. Ink-jet device according to claim 7, wherein said liquid repellent is formed of silicone or polytetrafluoroethylene.

9. Ink-jet device according to claim 1, wherein said deflection surface has a given defined roughness.

10. Ink-jet device according to claim 1, wherein said deflection surface has a defined texturing.

11. Ink-jet device according to claim 1, including means for selectively adjusting a relative velocity between the impacting droplets and said deflection surface.

12. Ink-jet device according to claim 11, wherein said deflection surface is movable by means of a driving device and oscillates, respectively, in or opposite to the direction of the trajectory so as to adjust the relative velocity.

13. Ink-jet device according to claim 12, wherein said driving device is a vibration device.

14. Ink-jet device according to claim 12, wherein said driving device is a deflection-surface swiveling device.

15. Ink-jet device according to claim 11, wherein said deflection surface is movable by means of a driving device and oscillates, respectively, as a function of the droplet-ejection frequency of the droplet-producing device.

16. Ink-jet device according to claim 1, wherein a flying velocity of the droplets is selectively adjustable by means of said droplet-producing device.

17. Ink-jet device according to claim 1, including a droplet-braking and/or accelerating device, the flying velocity of the droplets being selectively adjustable by means of one of said droplet-producing device and said droplet-braking and/or accelerating device.

18. Ink-jet device according to claim 1, wherein the trajectory is formed of a primary trajectory and at least one secondary trajectory, the droplets ejected by said droplet-producing device are primary droplets on the primary trajectory, and the droplets rebounding from the deflection surface are secondary droplets on the at least one secondary trajectory, and including a droplet splitting electrode arrangement for applying an electric field to the secondary droplets disposed in the vicinity of the secondary trajectory, and a charging device for electrically charging the primary droplets.

19. Ink-jet device according to claim 18, wherein said droplet-splitting electrode arrangement is disposed near said deflection surface.

20. Ink-jet device according to claim 18, wherein said charging device is a charging ring electrode situated in the primary trajectory.

21. Ink-jet device according to claim 18, including a deflecting electrode arrangement situated in the primary trajectory and disposed between said charging device and said deflection surface.

22. Ink-jet device according to claim 18, including a collecting element for respective secondary droplets, said collecting element being associated with said at least one secondary trajectory.

23. Ink-jet device according to claim 1, wherein said deflection surface is one of a plurality of deflection surfaces disposed so that a droplet formed by said droplet-producing device passes said plurality of deflection surfaces in succession.

24. Ink-jet device according to claim 1, including a plurality of droplet-producing devices, and means for feeding droplets produced thereby, grouped and in focus, to the recording medium.

25. Ink-jet process for producing an image on a recording medium, which comprises the steps of ejecting droplets along a trajectory, controlling the trajectory of the droplets with a droplet-controlling device formed as a deflection surface and disposed so that respective droplets impact thereon and rebound to continue the flight thereof, the respective droplets being splittable into at least two subdroplets as a function of selected parameters, and selecting parameters so that the respective droplets are split into at least two subdroplets.

26. Ink-jet process according to claim 25, wherein the parameters are selected from the group consisting of the surface characteristics of the deflection surface, the material of the deflection surface, the temperature of the deflection surface, the temperature of the droplets, the relative velocity between droplet and deflection surface and the angle of impact of the droplets on the deflection surface.

27. Ink-jet process according to claim 25, which includes splitting the subdroplets at least another time by colliding the subdroplets with a further deflection surface.

28. Ink-jet process according to claim 25, which includes forming a plurality of droplet streams having, in at least one thereof, droplets which have been split, and feeding streams of respective droplets and/or subdroplets, in grouped fashion, to the recording medium.

* * * * *